United States Patent [19]

Paterlini

[11] Patent Number: 4,597,114

[45] Date of Patent: Jul. 1, 1986

[54] SANITARY FACILITY WITH MEANS FOR AUTOMATIC CLEANING

[75] Inventor: Romualdo Paterlini, San Ilario d'Enza, Italy

[73] Assignee: Coopsette S.C.R.L., Castelnovo di Sotto, Italy

[21] Appl. No.: 692,659

[22] Filed: Jan. 17, 1985

[30] Foreign Application Priority Data

Jan. 20, 1984 [IT] Italy ..... 19265 A/84

[51] Int. Cl.[4] ..... E03D 9/00

[52] U.S. Cl. ..... 4/662; 15/21 C

[58] Field of Search ..... 4/662, 449, 546; 15/21 C, 21 B

[56] References Cited

U.S. PATENT DOCUMENTS 3,815,158 6/1974 Schnyder et al. ..... 4/420
3,969,133 7/1976 McTighe et al. ..... 4/662
4,210,973 7/1980 Decaux ..... 4/662
4,301,558 11/1981 Decaux ..... 4/662

FOREIGN PATENT DOCUMENTS 2482852 11/1981 France .
2499124 8/1982 France ..... 4/662

*Primary Examiner*—Stephen Marcus
*Assistant Examiner*—L. J. Peters
*Attorney, Agent, or Firm*—Karl F. Ross; Herbert Dubno

[57] ABSTRACT

An automatic sanitary facility for public or private use which comprises a service column connected to the electrical and hydraulic network and connectable to one or more toilet compartments, each provided with a floor-level or cup-shaped toilet bowl, the service column being equipped with automatic means for control and for hydraulic and mechanical cleaning, each of the mentioned bowls being transferable by means of an actuator to the inside of the service column for cleaning operations.

11 Claims, 8 Drawing Figures

SANITARY FACILITY WITH MEANS FOR AUTOMATIC CLEANING

FIELD OF THE INVENTION

My present invention relates to a public sanitary facility with improved means for cleaning the sanitary basins.

BACKGROUND OF THE INVENTION

Sanitary facilities for public use require an efficient cleaning treatment to ensure their hygiene. Such cleaning treatments have to be effected automatically, immediately after each use, in order to offer to each user the best conditions of cleanliness and hygiene.

Various installations have been proposed for this purpose, but the cleaning, either of the mechanical or the hydraulic type, does not always give satisfactory results and, since it is necessary in such installations to have a cleaning unit for each toilet bowl available, high installation costs are invariably involved.

This is especially important in the case of multiple facilities at the same location, provided for simultaneous use, as in the case of public places, out-door theaters, stadiums, fairs, comfort stations and so on, where the problem of hygiene is especially critical.

OBJECTS OF THE INVENTION

The principal object of my present invention is to provide a public facility with automatic cleaning, capable of insuring efficient and hygienic cleaning and suitable for use in multiple toilet or WC applications.

Another object of this invention is to provide an improved low-cost unit for cleaning a number of toilet stations of a multiple-stall public toilet facility.

Another object is to obviate the disadvantages of earlier toilet facilities.

SUMMARY OF THE INVENTION

According to the present invention an automatic sanitary facility for public or private use which can achieve the above and other objects comprises a service column adjacent to one or more toilet compartments or stalls each equipped with a floor-level or cup-shaped bowl, the service column being provided with automatic means for control and for hydraulic and mechanical cleaning and, in each of the compartments, an actuator for the automatic transfer of the bowl to the inside of the column when cleaning is required.

In particular, the service column has a brush with flexible bristles actuated by a motorized speed reducer and supported on a frame so as to be movable by means of an actuator between a raised rest position and a lowered operating position.

In addition, the service column comprises at least one washing pump supplying water or a cleaning liquid and a plurality of spray nozzles perimetrically arranged above the floor-level or cup-shaped bowl when this is in the service column.

The washing pump also supplies water or cleaning liquid to a rotating hydraulic manifold, whose movable portion is attached to the brush, which has a plurality of spray nozzles.

According to another feature of the invention a proportioning (dosage) pump can be provided for the purpose of metering to the rotating manifold a detergent and/or disinfectant and/or deodorant or similar liquid.

The column comprises storage tanks for the water and the detergent liquid, feeding respectively the washing pump and the proportioning pump, auxiliary service units, such as exhausts, hydraulic branching for lavatories, soap delivery, dryers with air, lights and the like, in a number corresponding to the compartments connected or connectable to the column and an electrical and electronic panel equipped with elements capable to monitor and control the successive operations of access, use and cleaning of the facility.

In each of the compartments to be used, the floor-level or cup-shaped bowl is movable on telescopic guides and its discharge port is provided with a closing element hinged laterally.

There also is provided a fixed guide profile angle or I-beam capable of keeping the discharge port closed while the bowl is in the compartment and allowing the opening thereof by gravity, when the floor-level bowl is in the service column.

In the lower part of the service column there is a hopper for conveying refuse to a chopper connected to the sewage system.

Advantageously, the service column has a square cross section. This way it is possible to connect it to four simultaneously usable compartments radially disposed around the column, the cleaning of the respective bowls being done in succession.

Alternatively, the service column with square cross section is automatically movable along rails disposed adjacent to one row or between two adjacent rows of compartments, the respective bowls being washable in succession, when by translatory movement the column reaches the corresponding position.

The column has an electrical and electronic panel comprising means capable of controlling in sequence the stages of access, use, translatory movement of bowl, cleaning, returning of each of the compartments to the conditions of free access, when all other stages are concluded.

Each of the toliet compartments is equipped with an automatic door, controlled from the electrical and electronic panel, having also means to signal the presence of a user in the respective compartment, as well as means, also controlled through the electrical and electronic panel, for ensuring that the cleaning starts only when the compartment is vacated.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
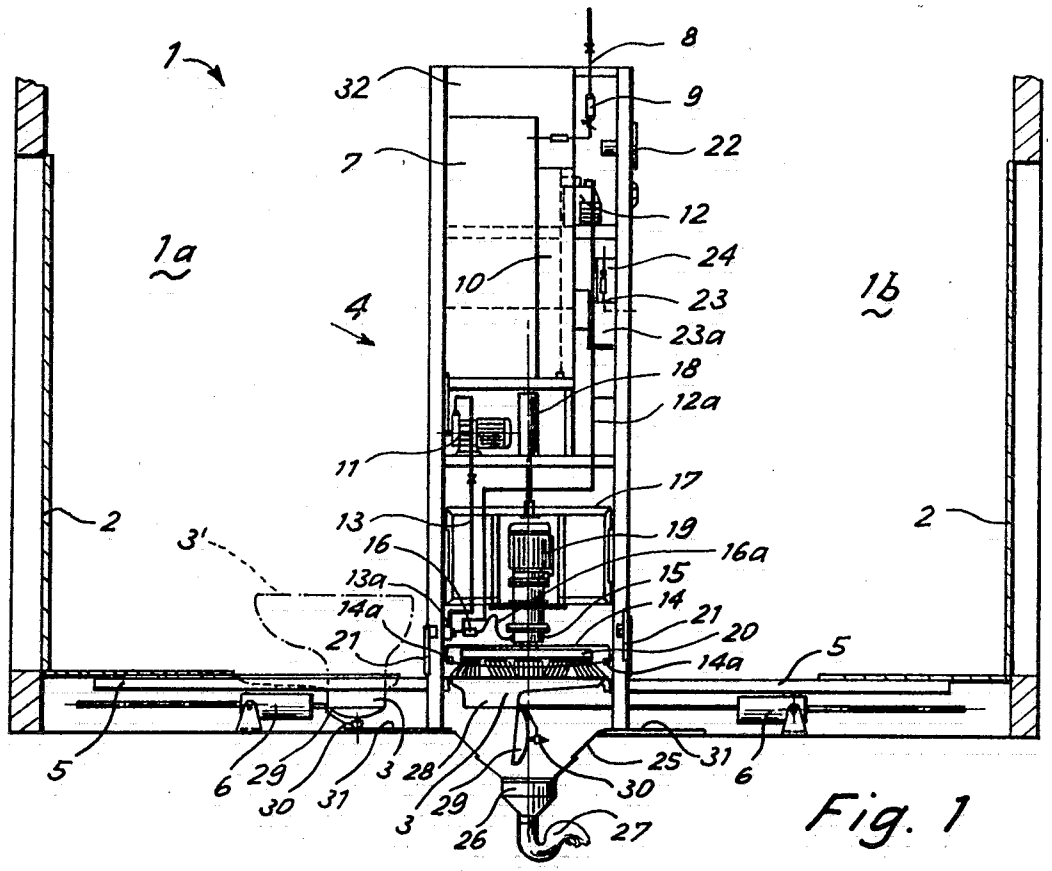
FIG. 1 is a sectional view of a facility according to the invention, having two toilet compartments opposite each other.

FIG. 1 shows in section a public sanitary facility, according to the invention, which comprises one or more toilet compartments 1 shown at 1*a*, 1*b*, etc each having an automatic access door 2 and a floor-level bowl 3 or a cup-shaped bowl 3'.

The compartments 1 are adjacent to a service column 4, carrying the hydraulic devices for cleaning and control. The bowl 3 is slidable on a telescopic guide 5 and is moved via an actuating element 6 from the service position in the compartment *1a* shown in FIG. 1 to the washing position in the service column 4, shown in FIG. 1 with respect to the compartment 1*b*.

The service column 4 comprises a water tank 7, supplied from the public water system through the pipe 8 and the solenoid valve 9, a tank for liquid detergent 10, a pump 11 supplied from the tank 7, a proportioning pump 12 which aspirates from the detergent tank 10. The pump 11 supplies the manifold 14 provided with washing nozzles 14*a* via the pipe 13 and the solenoid valve 13*a*. The pump also supplies the rotating hydraulic manifold 15 through the solenoid valve 16 and the flexible tube 16*a*, merging with the discharge pipe 12*a* coming from the pump 12.

In addition, there is a vertically slidable frame 17, moved by the actuator 18, which frame supports the motorized reducer 19, carrying the brush 20 having attached to it the movable portion of the rotating hydraulic manifold 15.

The passage between the space 1 and the service column 4 is provided with a partition 21 vertically slidable by means of a servomotor or the like, which is raised to allow the passage of the bowl 3' or of clogging detritus during the translatory meovement of the bowl 3 into the column 4.

To the column 4 there are also attached auxiliary fixtures such as an exhaust fan 22, pipe branchings 23 for the lavatories, a soap supplying device 23*a*, a hand drier 24, for instance supplying warm air to the stalls, fixtures for interior lights and for external signals; at the lower part of the column 4 there is a conical hopper 25 leading to a chopper 26 which discharges via the siphon 27 into the sewage system.

The discharge port 28 of the bowl 3 has a closing element consisting of a drain plug 29 hinged to the bowl 3 close to the connection point of the rod of the actuator 6.

Below this plug 29 there is a roller 30 connected to the plug 29 via elastic means, such as a spring or the like, which roller is adapted to act against the respective guide 31 which keeps the plug 29 closed when the bowl is in the compartment 1, and allows its opening due to gravity when the bowl 3 is introduced in the service column 4 for cleaning, thereby allowing the bowl to be discharged.

In the service column 4 there is in addition the electrical and electronic panel 32 which controls the sequence of the successive service operations, supplies the electrical appliances and also comprises a standby battery capable of making up for an unexpected power breakdown in the supply lines.

The facility according to the invention, operates as follows: when it is available for use a luminous signal "vacant" appears on the outside of the compartment 1 near the access door 2 under the control of the panel 32.

It is then possible to enter the facility by commanding the opening through the introduction of a coin or token, for instance, and then following the sensing by a photoelectric cell, at the exterior a luminous signal "occupied" appears and the door 2 closes automatically.

After use, the user exits and the door 2 recloses automatically behind him; when adequate means of control such as radar, photocells or the like have verified that the compartment 1 was vacated, the cleaning cycle as illustrated in the sequence of FIGS. 4, 5, 6, 7, 8 begins.

Figure 4:
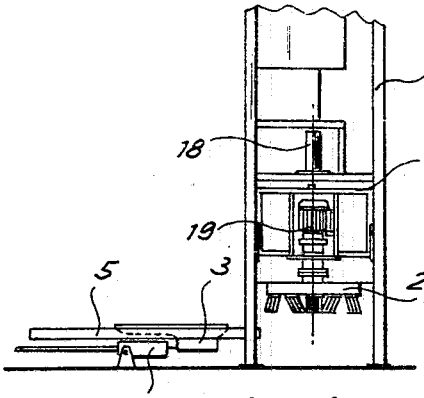
FIGS. 4, 5, 6, 7 and 8 are diagrams of the sequence of successive stages of a cleaning cycle.
Figure 5:
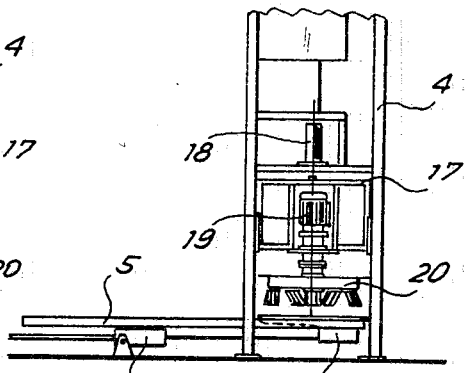

The actuator 6, advantageously of an electrical type, integral with the bowl 3 or 3' carries the bowl into the column 4 by sliding on the guides 5 (FIGS. 4 and 5). During the horizontal translatory movement of the piston, the partition 21 is raised permitting the bowl 3' or the clogging detritus to enter the service column and the closing plug 29 of the discharge port 28 of the bowl 3 opens to allow the discharge of the detritus, which this way reaches the chopper and subsequently is discharged into the sewer by passing through the siphon 27.

Once the actuator reaches the end of its run and the bowl 3 is in the column, the pump 11, which feeds the nozzles 14*a* carrying out a preliminary washing and discharging, starts operating.

Figure 6:
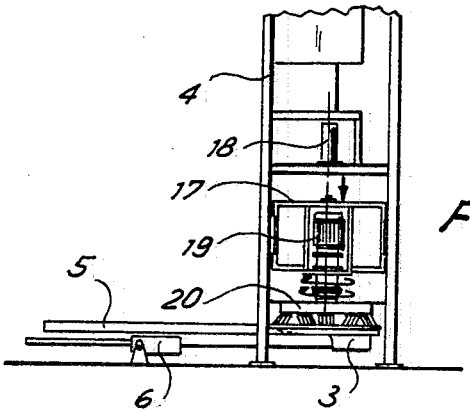
Figure 7:
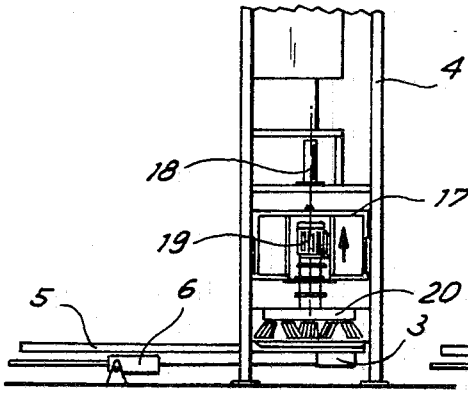

When the pre-wash stage is finished, the motorized reducer 19 starts the vertical actuator (hydraulic piston-cylinder pack) 18 which brings the brushes 20 close to the bowl; when the actuator 18 reaches the end of its run, an order is given to the solenoid valve 16 which opens while the valve 13*a* of the nozzles 14*a* recloses and thus the water delivered under pressure from the pump 11 enters the rotating manifold 15 and is discharged from the bottom of the brush 20 through conveniently located holes (FIG. 6).

To the manifold 15 another detergent and disinfectant liquid is delivered under pressure, upstream of the solenoid valve 13*a* by the proportioning pump 12, aspirating it from the tank 10.

After rotating for a few seconds in one direction and then in the opposite direction, the brush stops turning, the centrifugal pump 11 and the proportioning pump 12 stop operating.

Figure 8:
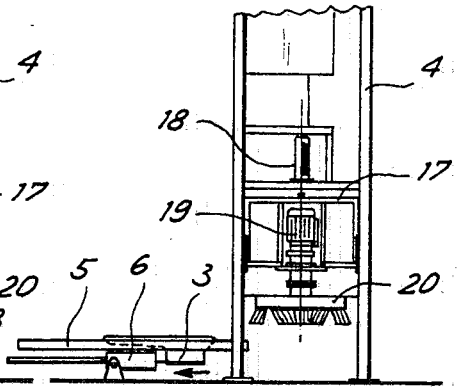

The actuator 18 returns the brush 20 to the rest position (FIG. 7), raising the frame 17 and when the end of the run is reached the actuator 4 starts returning the bowl 3 to the compartment 1 (FIG. 8). When the cleaning cycle is finished, the interior lights and the exhaust fan 22 are turned off and the sign "vacant" appears in the area of the slot for coin-insertion, which is ready now to receive a new coin to start another cycle.

The electrical appliances mentioned in this specification, as well as other various auxiliary fixtures not mentioned are all controlled by the electrical panel 32, wherein batteries are provided for standby in the case of power failure, providing the necessary energy for the lighting, exhaust, for the motor of the sliding door, and for the execution of the entire cleaning cycle in process at the time. Usually, the water required by the operation is supplied from the public system; the water enters the storage tank 7 and due to two electromagnetic sensors connected to a solenoid valve is kept therein at an almost constant level.

The storage tank 7 serves to compensate for cases of surges in demand, as for instance when water is used simultaneously during cleaning of the bowl 3 also for the floors of the compartments 1*a*, 1*b*.

The facility according to the invention provides in addition further safety devices, controlled from the electrical panel 32, such as a weight sensor connected to the floor of the compartments 1*a*, 1*b*, which prevents the closing of the door 2 in case of overload on the floor, thus avoiding the presence of more than one person in the stall, and a time-control device, which will open the door automatically after a pre-established period of time, for instance 15 minutes, possibly preceded by a signal to the occupant, as a safeguard in cases of sickness and to prevent abuse.

Figure 2:
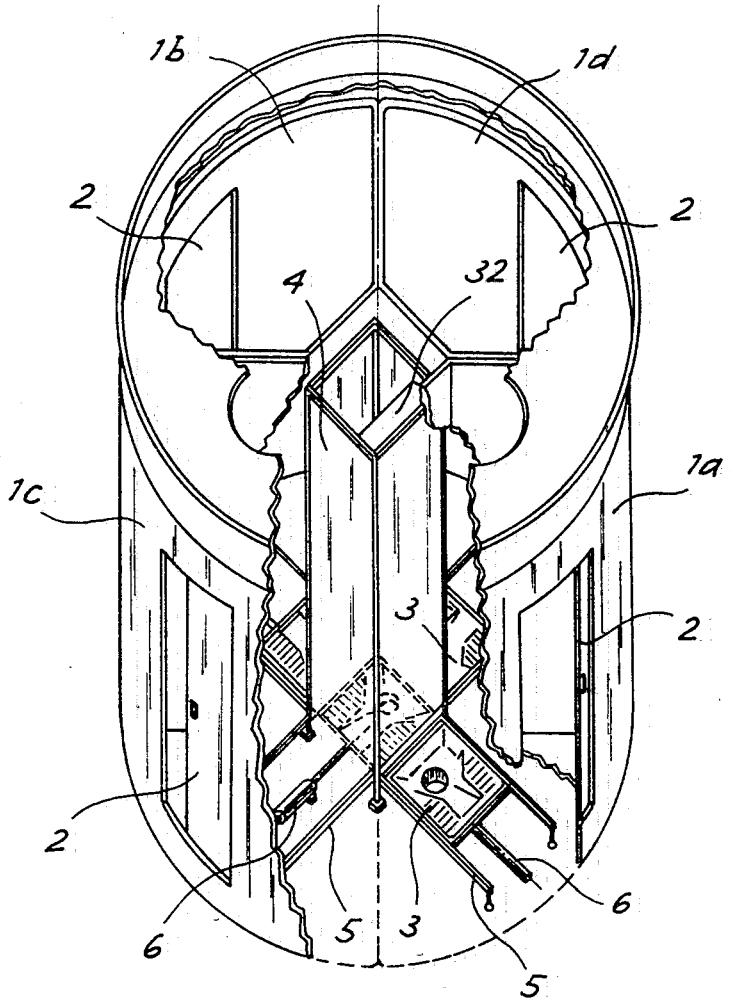
FIG. 2 is a view of a facility with four compartments arranged around a service column according to the invention.

FIG. 2 shows a facility according to the invention, consisting of a central service column 4 having four adjacent compartments 1*a*, 1*b*, 1*c*, 1*d*, all provided with a bowl 3 slidable along the guides 5 by means of the respective piston-and-cylinder hydraulic actuators 6. The compartments 1*a*, 1*b*, 1*c*, 1*d* each have a slidable door 2 and can be arranged as shown, in a manner to form a cylindrical structure; it is also possible in such embodiments to provide a lower number of compartments, leaving free one or more circular sectors corresponding to the compartments 1, gaining space for various use such as storage sheds, vending machines, telephone booths and others.

Figure 3:
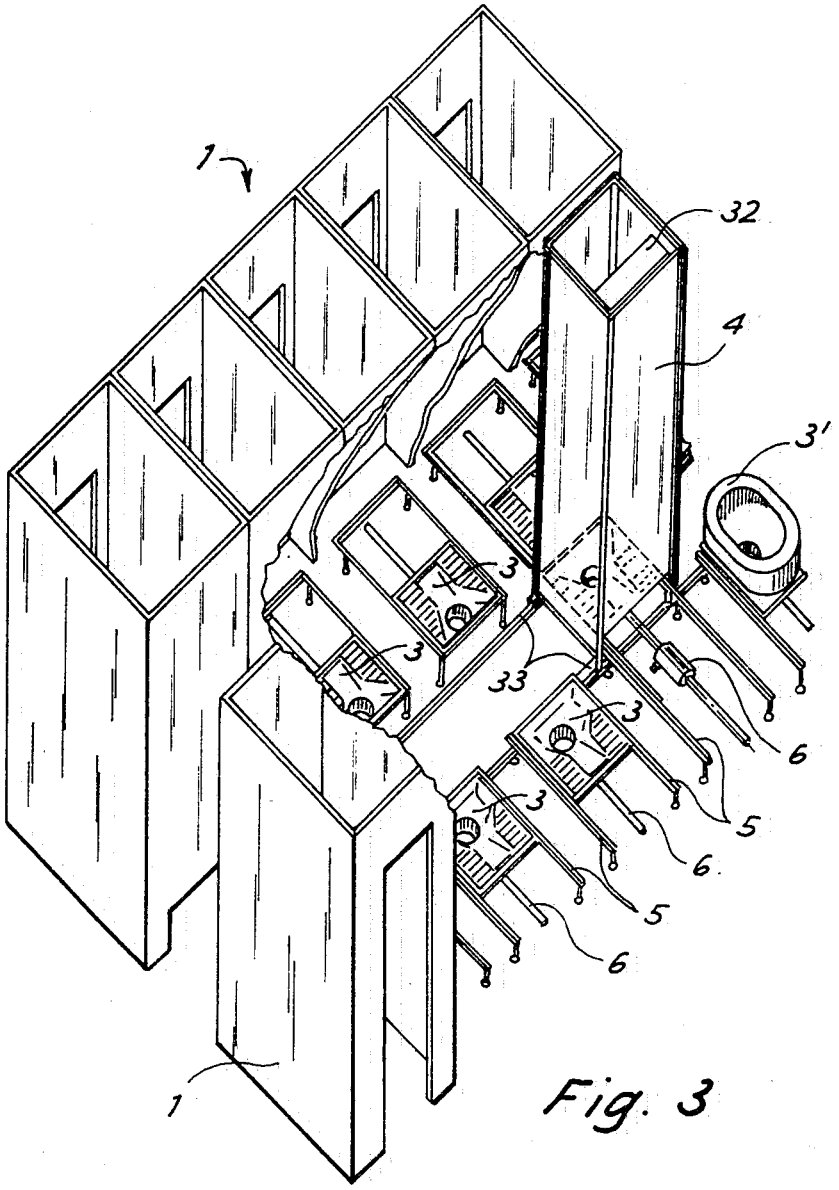
FIG. 3 is a view of an installation with a movable service column, connectable to two rows of toliet compartments.

In FIG. 3 a column 5 is movable along rails 33 arranged between two rows of compartments 1, opposite to each other. In such an embodiment an electric motor is provided, positioned on the ground or at the extremity of column 4, the motor being controlled from the electrical or electronic panel 32 and by means of wheels, chains or toothed racks or the like causes a translatory movement of the column in the desired position. In this way it is possible for a single column 4 to serve a high number of compartments 1. These installations are particularly suitable for crowded public places, such as stadiums, theaters, fairs, comfort stations and the like. A movable connection must be provided for supplying the electricity to the column 4, by means of a contact rail or a flexible cable.

The hydraulic connection can be made by means of a flexible hose or by an element for automatic branching in a fixed position, allowing the periodic replenishment of the tank 7 of the service column 4.

In order to simplify the structure of the column 4, its actuating elements are of the electrical type, so that they do not require compressors and pump housings. Actuators of hydraulic, pneumatic or similar type for translation can be used.

Variations of the described operation cycle, or the structure of the facility, within the scope of the claims form part of the present invention. The devices for service, safety or auxiliary fixtures such as lighting, push-buttons, photocells and the like can be of the known type and for this reason have been described only summarily.

I claim:

1. An automatic sanitary facility comprising:
a plurality of toilet compartments;
a service column adjacent said toilet compartments;
a toilet bowl for each compartment shiftable into said service column and back from said service column into the respective compartment; and
automatic means in said service column for controlling the transfer of each of said bowls from each of said compartments in turn into and out of said service column and for hydraulically and mechanically scrubbing said bowls within said column, said service column comprising a brush with flexible bristles actuated by a motorized reducer and supported by a frame, movable by means of an actuator between a raised rest position and a lowered working position.

2. The facility defined in claim 1 wherein said service column has at least one washing pump supplying water or washing liquid to a plurality of spray nozzles located perimetrically above said bowl, when the bowl is within said service column.

3. The facility defined in claim 2 wherein said washing pump supplies water or washing liquids to a rotating hydraulic manifold having a movable portion in the form of an integral part of said brush, said brush being provided with a plurality of spray nozzles.

4. The facility defined in claim 3, further comprising a metering pump for supplying said manifold with a detergent, disinfectant or deodorant liquid.

5. The facility defined in claim 4 wherein said column comprises storage tanks for water and liquid detergents, respectively supplying said washing pump and said metering pump, auxiliary service units including an exhaust fan, hydraulic branches for lavatories, a soap feeder, a hot air drier and lights in numbers corresponding to the number of compartments serviced by said column and an electric and electronic panel provided with elements for monitoring and controlling the successive operations of access, use and cleaning of said facility.

6. The facility defined in claim 5 wherein each of said toilet compartments is provided with an automatic door controlled from said electric and electronic control panel, being also provided means for signaling the presence of a user in said compartment, capable to ensure via said electric and electronic control panel, that the cleaning starts only when same compartment is vacant.

7. An automatic sanitary facility comprising:
a plurality of toilet compartments;
a service column adjacent said toilet compartments;
a toilet bowl for each compartment shiftable into said service column and back from said service column into the respective compartment; and
automatic means in said service column for controlling the transfer of each of said bowls from each of said compartments in turn into and out of said service column and for hydraulically and mechanically scrubbing said bowls within said column, said bowl being movable on telescopic guides, said bowl having a discharge port being provided with a closing element and provided with means capable to keep said discharge port closed while said bowl is in the toilet compartment and to cause its opening when said bowl is within the service column.

8. An automatic sanitary facility comprising:
a plurality of toilet compartments;
a service column adjacent said toilet compartments;
a toilet bowl for each compartment shiftable into said service column and back from said service column into the respective compartment; and
automatic means in said service column for controlling the transfer of each of said bowls from each of said compartments in turn into and out of said service column and for hydraulically and mechanically scrubbing said bowls within said column, a waste-receiving hopper being provided at a lower side of said service column and being connected by a chopper to a sewage system.

9. An automatic sanitary facility comprising:
a plurality of toilet compartments;
a service column adjacent said toilet compartments;
a toilet bowl for each compartment shiftable into said service column and back from said service column into the respective compartment; and
automatic means in said service column for controlling the transfer of each of said bowls from each of said compartments in turn into and out of said service column and for hydraulically and mechanically scrubbing said bowls within said column, said service column having a square cross section, surrounded by up to four toilet compartments radially arranged around said service column and connected thereto for simultaneous use, the bowls of said compartments being movable into said column for the cleaning operation, in a sequence according to a pre-established program.

10. An automatic sanitary facility comprising:

a plurality of toilet compartments;

a service column adjacent said toilet compartments;

a toilet bowl for each compartment shiftable into said service column and back from said service column into the respective compartment; and automatic means in said service column for controlling the transfer of each of said bowls from each of said compartments in turn into and out of said service column and for hydraulically and mechanically scrubbing said bowls within said column, said service column having a rectangular cross section, said column being automatically movable along rails along at least one row of compartments connectable to said column, the respective bowls being cleanable in a sequence according to a pre-established program.

11. The facility defined in claim 10 wherein said column has an electric and electronic control panel with means capable to monitor in sequence the steps of access, use, translatory movement of the bowl, cleaning and returning to the conditions of free access of each of the toilet compartments depending therefrom.

* * * * *